US010822724B2

(12) United States Patent
Yao et al.

(10) Patent No.: US 10,822,724 B2
(45) Date of Patent: Nov. 3, 2020

(54) MANUFACTURING APPARATUS FOR DELAMINATING BAMBOO INTO FIBER AND METHOD THEREOF

(71) Applicant: JIYANG COLLEGE OF ZHEJIANG A&F UNIVERSITY, Zhuji (CN)

(72) Inventors: Wenbing Yao, Zhuji (CN); Chao Zhou, Zhuji (CN); Maoyang Lin, Zhuji (CN); Yao Yao, Zhuji (CN)

(73) Assignee: JIYANG COLLEGE OF ZHEJIANG A&F UNIVERSITY, Zhuji (CN)

( * ) Notice: Subject to any disclaimer, the term of this patent is extended or adjusted under 35 U.S.C. 154(b) by 249 days.

(21) Appl. No.: 15/770,492

(22) PCT Filed: Nov. 28, 2016

(86) PCT No.: PCT/CN2016/107415

§ 371 (c)(1),
(2) Date: Apr. 23, 2018

(87) PCT Pub. No.: WO2018/094716

PCT Pub. Date: May 31, 2018

(65) Prior Publication Data

US 2019/0054649 A1 Feb. 21, 2019

(51) Int. Cl.

| | |
|---|---|
| ***D01B 1/14*** | (2006.01) |
| ***B27J 1/00*** | (2006.01) |
| *B27N 3/04* | (2006.01) |
| *D01B 1/10* | (2006.01) |

(52) U.S. Cl.
CPC ..... *D01B 1/14* (2013.01); *B27J 1/00* (2013.01); *B27N 3/04* (2013.01); *D01B 1/10* (2013.01)

(58) Field of Classification Search
CPC ..... D01B 1/14–46; B27J 1/00
See application file for complete search history.

(56) References Cited

U.S. PATENT DOCUMENTS

| | | | | | |
|---|---|---|---|---|---|
| 671 | A * | 4/1838 | Kyes | ..... | D01B 1/22 19/23 |
| 16,365 | A * | 1/1857 | Little | ..... | D01B 1/22 19/23 |
| 77,553 | A * | 5/1868 | Wallace | ..... | D01B 1/14 19/26 |
| 95,659 | A * | 10/1869 | Crandal | ..... | D01B 1/22 19/22 |

(Continued)

*Primary Examiner* — Shaun R Hurley
(74) *Attorney, Agent, or Firm* — Leong C. Lei

(57) ABSTRACT

An apparatus for delaminating a bamboo into fibers includes a machine frame, a machine seat arranged in a middle of the machine, a machine cover matching with the machine seat, a push plate, a power source, and an elastic member. The machine seat includes multiple grooves formed in a top to respectively receive therein bamboo pieces. The machine cover includes multiple ribs formed on a bottom thereof. The machine cover is slidable relative to the machine seat to have the ribs of the machine cover respectively receivable in and engageable with the grooves of the machine seat so as to sandwich bamboo pieces therebetween. A push plate is driven by the power source to selectively move relative to the machine seat and has a bent end portion that bends and pushes portions of the bamboo pieces to slide on the top of the machine cover.

6 Claims, 7 Drawing Sheets

(56) References Cited

U.S. PATENT DOCUMENTS

| | | | | | |
|---|---|---|---|---|---|
| 197,063 | A * | 11/1877 | Tabler | D01B 1/22 | 19/22 |
| 882,766 | A * | 3/1908 | Mitchell et al. | D01B 1/22 | 19/19 |
| 915,125 | A * | 3/1909 | Summers | D01B 1/14 | 19/11 |
| 921,499 | A * | 5/1909 | Anderson | D01B 1/22 | 19/22 |
| 938,722 | A * | 11/1909 | Summers | D01B 1/22 | 19/23 |
| 1,315,328 | A * | 9/1919 | Pritchard | D01B 1/22 | 19/24 |
| 1,329,973 | A * | 2/1920 | Jardine | B27J 1/00 | 241/159 |
| 2,156,122 | A * | 4/1939 | Marczak | D01B 1/30 | 19/10 |
| 3,674,219 | A * | 7/1972 | Harvey, Jr. | B27L 11/08 | 241/152.2 |
| 5,720,083 | A * | 2/1998 | Leduc | D01B 1/16 | 19/24 |
| 2010/0178451 | A1* | 7/2010 | Li | B27L 7/00 | 428/106 |
| 2011/0180182 | A1* | 7/2011 | James | B27L 7/00 | 144/2.1 |
| 2013/0281578 | A1* | 10/2013 | Jiang | A01F 7/02 | 524/9 |
| 2014/0370288 | A1* | 12/2014 | Sherwood | B27J 1/00 | 428/401 |

* cited by examiner

MANUFACTURING APPARATUS FOR DELAMINATING BAMBOO INTO FIBER AND METHOD THEREOF

BACKGROUND OF THE INVENTION

Field of the Invention

The present invention relates to a bamboo process, and more particularly to a manufacturing apparatus for delaminating a bamboo into fiber and a method thereof.

Description of the Prior Art

Bamboo retting is a prerequisite for the refined extraction of bamboo fiber and the basis for manufacturing conforming bamboo fiber. Demand for bamboo fiber has greatly increased with the boom in the emerging bamboo fiber industry.

Currently, bamboo fiber is mainly produced by mechanical method in the industry, i.e. bamboo is crushed to create cracks and bamboo fiber is separated out from thin bamboo sheets. However, the disadvantage of mechanical method is that the crushing force is not comparable with all specifications of bamboo, causing uneven pressure on different parts of the bamboo and creating uneven distribution of cracks, consequently affecting the extraction of bamboo fiber. There are also manufacturers that adopt the chemical method of producing bamboo fiber, i.e. bamboo is soaked in alkaline solution to obtain plant fiber through the degradation of hemicellulose and lignin. However, the disadvantage of chemical method is that the disintegration of cellulose, hemicellulose and lignin is inconsistent on the inside and outside as the chemical solution acts on the surface of the bamboo, causing uneven fiber length and thickness in the interior. Consequently, conformance rate and output rate are low, fiber production cost is high, and fiber produced can only be used in fiberboard or low-grade composite materials.

SUMMARY OF THE INVENTION

One of the technical problems to be solved by the present invention is to provide a manufacturing apparatus for delaminating a bamboo into fiber.

Another of the technical problems to be solved by the present invention is to provide a manufacturing method for delaminating a bamboo into fiber.

The present invention solves one of the above technical problems through the following technical solution. A manufacturing apparatus for delaminating a bamboo into fiber, comprising a machine frame, a machine seat, a machine cover matched with the machine seat, a machine cover rail, a push plate, a push rail, at least one power source for sliding the push plate, and at least one elastic member;

the machine seat being disposed at a middle portion of the machine frame, a top of the machine seat being provided with a plurality of juxtaposed grooves and a first heating assembly, the first heating assembly being embedded in the machine seat and located under the grooves; a bottom of the machine cover being provided with a plurality of ribs and a second heating assembly, the ribs corresponding in position and in number to the grooves, the second heating assembly being embedded in the machine cover and located above the ribs;

the machine cover rail and the push rail being arranged on the machine frame respectively, the machine cover being slidably fitted on the machine cover rail, a left side of the machine cover being a curved surface, the curved surface having a radius of 8-20 mm, the machine cover being connected with a right end portion of the machine frame through the elastic member, the push plate being slidably fitted on the push rail, the power source being connected with the push plate;

the machine cover rail including a left rail section and a right rail section arranged from left to right, the left rail section being arranged along the machine seat and located above the machine seat;

a right end portion of the push plate being bent upwards to form a bent portion, an included angle of 100-150° being defined between the bent portion and the push plate; the push rail including a lower linear section, a curved section and an upper linear section arranged from left to right, the lower linear section being lower than the grooves, the curved section being connected between the upper linear section and the lower linear section, the upper linear section being parallel to the left rail section and located above the left rail section; wherein when the push plate is slid to the upper linear section, a lower surface of the push plate is attached to an upper surface of the machine cover.

Preferably, the push plate is connected to the power source through a pulley.

Preferably, the first heating assembly is composed of a plurality of first heating strips evenly distributed and staggered with the grooves; and the second heating assembly is composed of a plurality of second heating strips evenly distributed and staggered with the ribs.

Preferably, the elastic member is a compression spring. One end of the compression spring is connected to the right end portion of the machine frame, and another end of the compression spring is connected to a right end portion of the machine cover.

The present invention solves another of the above technical problems through the following technical solution. A manufacturing method for delaminating a bamboo into fiber by using the aforesaid manufacturing apparatus, comprising the following steps:

(1) the machine cover being pushed to slide to the right rail section, the elastic member being compressed; bamboo strips being placed one by one in the grooves of the machine seat, respective woody parts of the bamboo strips being attached to the grooves, the bamboo strips each having a portion of about 5-8 cm exposed outside the grooves of the machine seat, the exposed portions of the bamboo strips being located on a left side of the machine seat;

(2) the machine cover covering the machine seat, the ribs of the machine cover pressing the bamboo strips, the first heating assembly and the second heating assembly being actuated simultaneously, the first heating assembly and the second heating assembly jointly heating the bamboo strips at a heating temperature of 180-450°;

(3) after the bamboo strips are heated for 3-10 minutes, the first heating assembly and the second heating assembly being turned off, the woody parts of the bamboo strips located at the left side of the machine seat being cut off, then, the power source being turned on to drive the push plate to slide along the push rail and move from the lower linear section to the upper linear section, during sliding of the push plate, the bamboo strips being bent, crushed and stretched to be defamed so that fibers and base structures of the bamboo strips are slowly delaminated and peeled and bamboo fiber is separated from the bamboo strips, the woody parts of the bamboo strips being completed separated from green parts of the bamboo strips;

(4) when the push plate being slid to completely locate on the upper linear section, a set of bamboo strips being delaminated into fiber, and then the push plate being returned to its original position, i.e., the upper linear section, under the action of the power source; finally, the separated bamboo fiber being taken out.

Preferably, the first heating assembly is composed of a plurality of first heating strips evenly distributed and staggered with the grooves; and the second heating assembly is composed of a plurality of second heating strips evenly distributed and staggered with the ribs.

Preferably, the elastic member is a compression spring, one end of the compression spring is connected to the right end portion of the machine frame, and another end of the compression spring is connected to the right end portion of the machine cover.

The beneficial effects of the present invention are described below:

The invention provides a manufacturing apparatus for delaminating a bamboo into fiber, which has a relatively simple structure and is easy for operation, use, and promotion. The manufacturing method of the invention using the manufacturing apparatus is simple in production process, high in efficiency, and free from pollution. The obtained bamboo fiber has good elasticity, good toughness, fine fiber fineness and uniformity, that is, the present invention can quickly and efficiently produce high-quality bamboo fiber, greatly saving the production time of bamboo fiber, improving the production efficiency, and reducing the production cost.

BRIEF DESCRIPTION OF THE DRAWINGS

Embodiments of the present invention will now be described, by way of example only, with reference to the accompanying drawings.

DETAILED DESCRIPTION OF THE PREFERRED EMBODIMENTS

Figure 1:
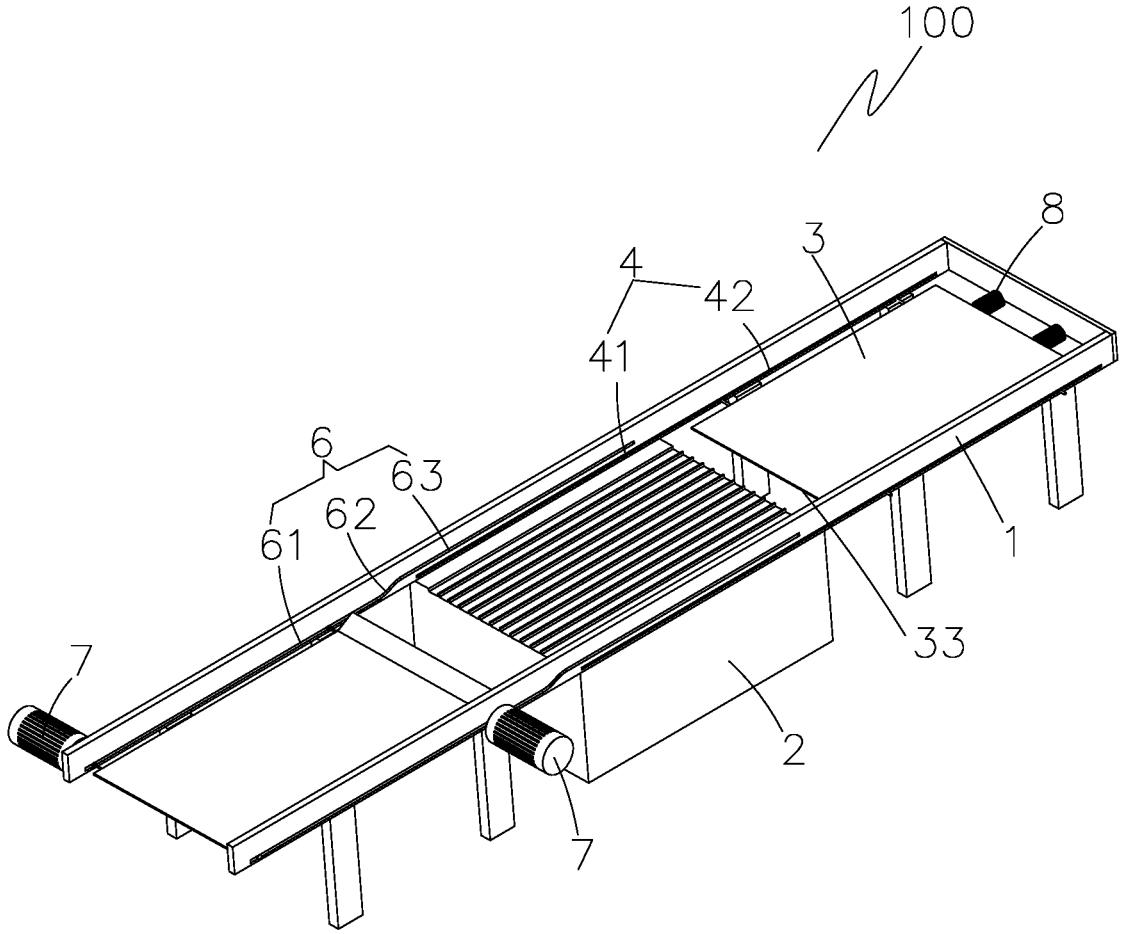
FIG. 1 is a schematic view of the manufacturing apparatus for delaminating a bamboo into fiber according to the present invention.

Please refer to FIG. 1 to FIG. 7. A manufacturing apparatus 100 for delaminating a bamboo into fiber according to the present invention comprises a machine frame 1, a machine seat 2, a machine cover 3 matched with the machine seat 2, a machine cover rail 4, a push plate 5, a push rail 6, at least one power source 7 for sliding the push plate 5, and at least one elastic member 8. In this embodiment, the elastic member 8 is a compression spring. One end of the compression spring is connected to the right end portion of the machine frame 1. Another end of the compression spring is connected to the right end portion of the machine cover 3.

The machine seat 2 is disposed at a middle portion of the machine frame 1. The top of the machine seat 2 is provided with a plurality of juxtaposed grooves 21 and a first heating assembly 22. The first heating assembly 22 is embedded in the machine seat 2 and located under the grooves 21. The grooves 21 are used for placing bamboo strips. The first heating assembly 22 is used to heat the bamboo strips placed in the grooves 21. The bottom of the machine cover 3 is provided with a plurality of ribs 31 and a second heating assembly 32. The ribs 31 correspond in position and in number to the grooves 21. The second heating assembly 32 is embedded in the machine cover 3 and located above the ribs 31. When the machine cover 3 covers the machine seat 2, the ribs 31 are just inserted into the grooves 21 to press against the bamboo strips in the grooves 21. The second heating assembly 32 is used to heat the bamboo strips placed in the grooves 21.

The machine cover rail 4 and the push rail 6 are arranged on the machine frame 1, respectively. The machine cover 3 is slidably fitted on the machine cover rail 4. The left side of the machine cover 3 is a curved surface 33, so that the bamboo strips pushed by the push plate 5 are bent along the curved surface 33. The machine cover 3 is connected with the right end portion of the machine frame 1 through the elastic member 8. The push plate 5 is slidably fitted on the push rail 6. The power source 7 is connected with the push plate 5. The machine cover rail 4 includes a left rail section 41 and a right rail section 42 arranged from left to right. The left rail section 41 is arranged along the machine seat 2 and located above the machine seat 2. When the machine cover 3 is not applied with an external force, the machine cover 3 is located on the left rail section 41 and covers the machine seat 2, and the ribs 31 are just inserted into the corresponding grooves 21. When the machine cover 3 is slid to the right rail section 42 by applying an external force, the elastic member 8 is defamed by compression. After the external force is removed, the machine cover 3 slides back to its original position, i.e., the left rail section 41, due to the elastic restoring force of the elastic member 8.

The right end portion of the push plate 5 is bent upwards to form a bent portion 51. The included angle between the bent portion 51 and the push plate 5 is a, and $\alpha$=100°-150°. The push rail 6 includes a lower linear section 61, a curved section 62 and an upper linear section 63 arranged from left to right. The lower linear section 61 is lower than the grooves 21, so that the push plate 5 can be located a position lower than the bamboo strips placed in the grooves 21 when the push plate 5 slides on the lower linear section 61, so as to ensure that the bent portion 51 can push up the ends of the bamboo strips and bend the bamboo strips upwards when contacting the bamboo strips. The curved section 62 is connected between the upper linear section 61 and the lower linear section 63. The upper linear section 61 is parallel to the left rail section 41 and is located above the left rail section 41. When the push plate 5 is slid to the upper linear section 61, the lower surface of the push plate 5 is attached to the upper surface of the machine cover 3, so that the push plate 5 can push the bamboo strips to move on the upper surface of the machine cover 3.

In this embodiment, the push plate 5 is connected to the power source 7 through a pulley (not shown). The first heating assembly 22 is composed of a plurality of first heating strips 221 that are evenly distributed and staggered with the grooves 21. The second heating assembly 32 is composed of a plurality of second heating strips 321 that are evenly distributed and staggered with the ribs 31. The specific structures of the first and second heating strips 22, 32 can ensure uniform heating for the bamboo strips.

Figure 2:
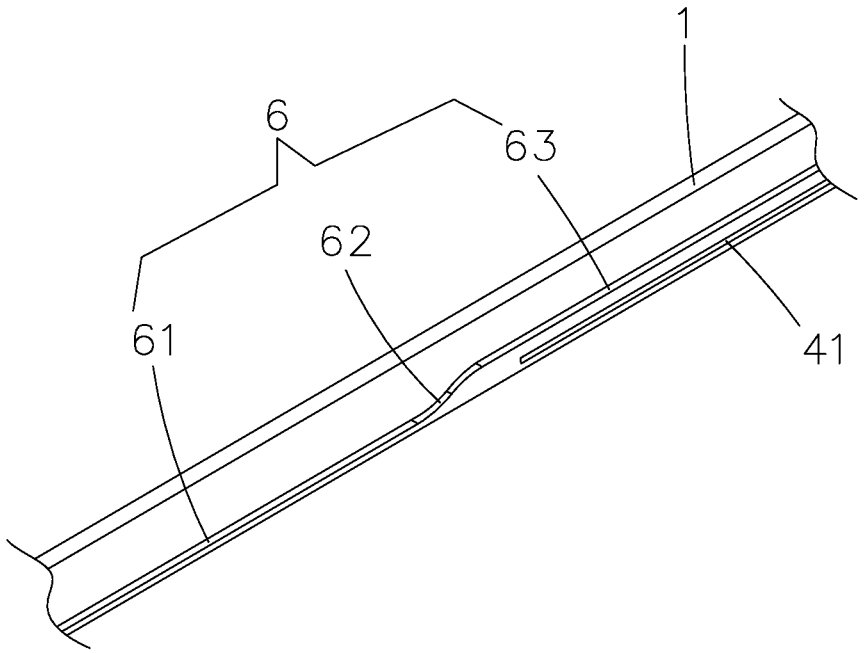
FIG. 2 is a partial schematic view of the machine frame according to the present invention.
Figure 3:
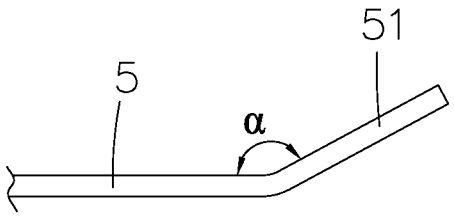
FIG. 3 is a schematic view of the push plate according to the present invention.
Figure 4:
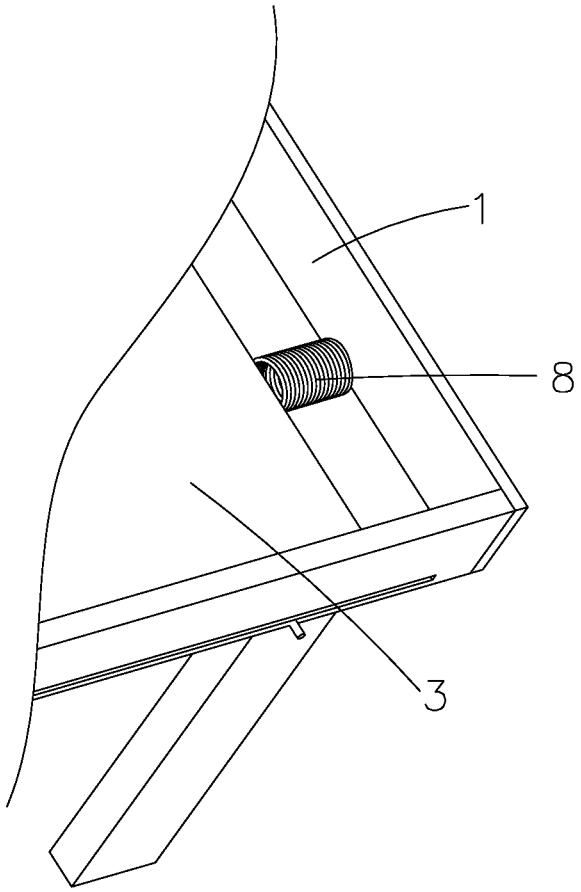
FIG. 4 is a schematic view of the machine frame and the elastic member according to the present invention.
Figure 5:
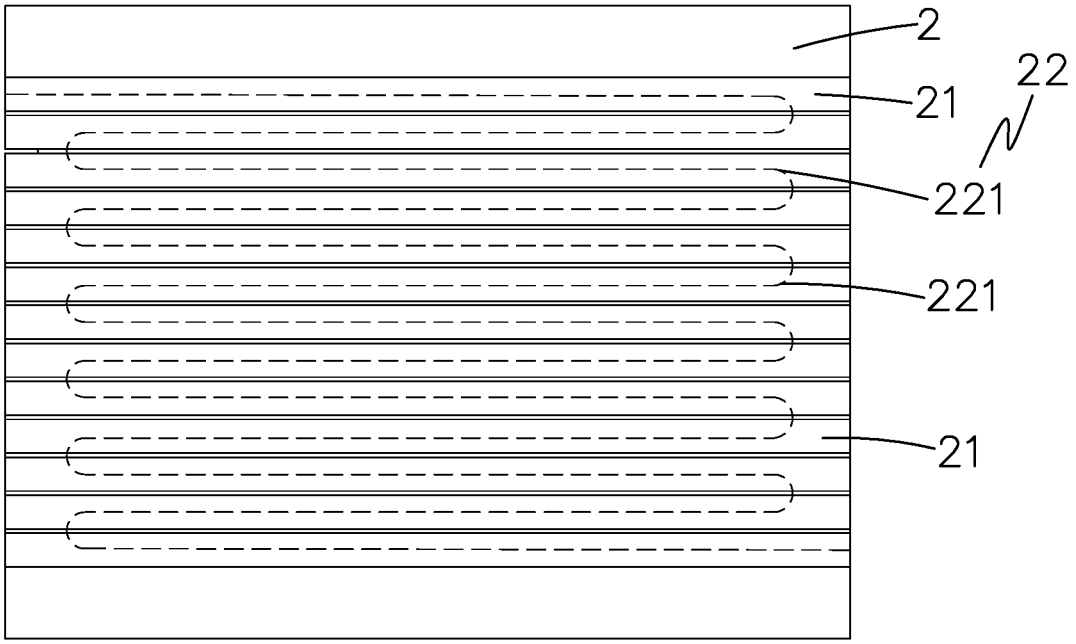
FIG. 5 is a top view of the machine seat according to the present invention.
Figure 6:
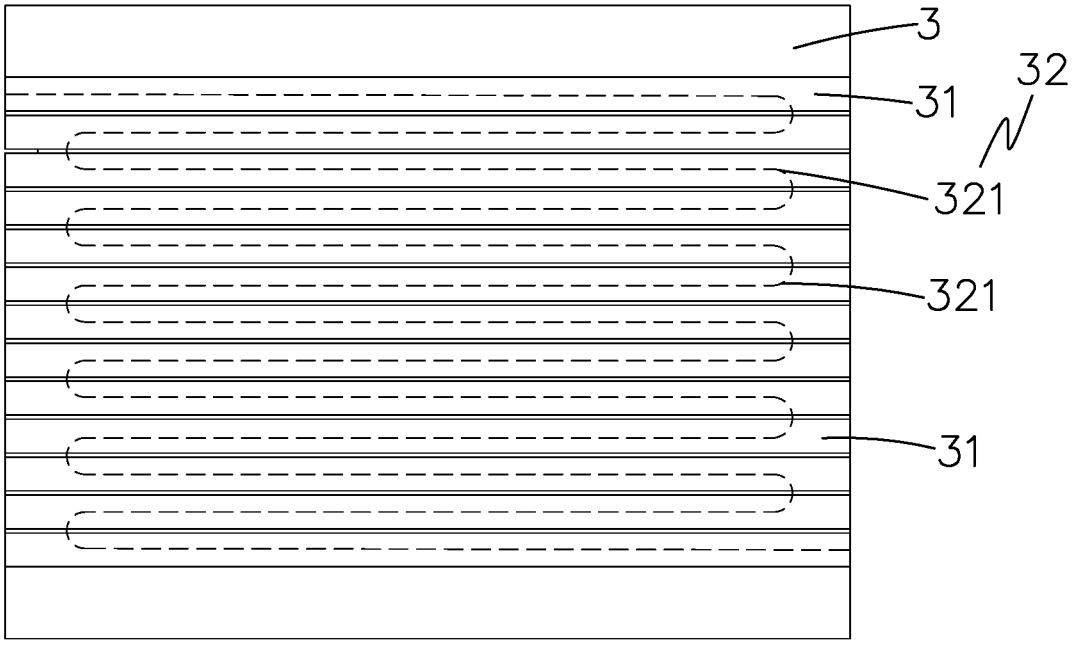
FIG. 6 is a bottom view of the machine cover according to the present invention.
Figure 7:
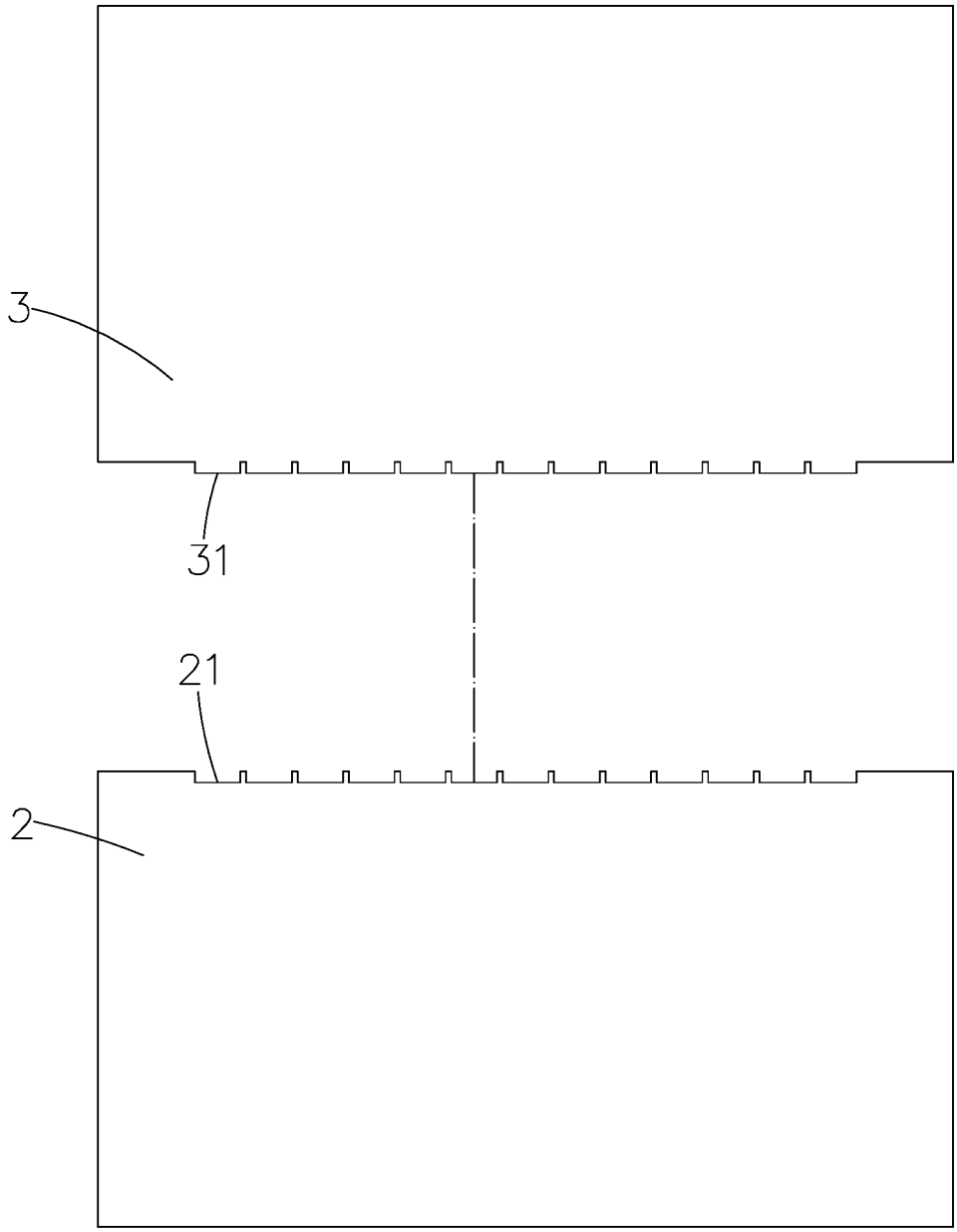
FIG. 7 is a side view of the machine seat and the machine cover according to the present invention.

Referring to FIG. 1 to FIG. 4 again, a manufacturing method for delaminating a bamboo into fiber according to the present invention is implemented based on the above-described manufacturing apparatus 100. The specific operations of the manufacturing method are described as follows:

The machine cover 3 is pushed to slide to the right rail section 42 and the elastic member 8 is compressed; then, bamboo snips (not shown) are placed one by one in the grooves 21 of the machine seat 2 to ensure that the woody parts of the bamboo snips are attached to the grooves 21. The bamboo snips each have a portion of about 5-8 cm exposed outside the grooves 21 of the machine seat 2, and the exposed portions of the bamboo strips are located on the left side of the machine seat 2, i.e., the exposed portions of the bamboo snips are located between the curved sections 62.

After that, the machine cover 3 covers the machine seat 2. The ribs 31 of the machine cover 3 are adapted to press the bamboo snips. The first heating assembly 22 and the second heating assembly 32 are actuated simultaneously. The first heating assembly 22 and the second heating assembly 32 jointly heat the bamboo snips at a heating temperature of 180-450°.

After the bamboo snips are heated and reformed for 3-10 minutes, the first heating assembly 22 and the second heating assembly 32 are turned off. The woody parts of the bamboo snips located at the left side of the machine seat 2 are cut off (Specifically, a cutting blade may be used for cutting to achieve the purpose of cutting the woody parts of the bamboo snips. In general, the cutting thickness is about 1/25 of the thickness of each of the bamboo snips, so as to cut off the woody parts of the bamboo strips.) Then, the power source 7 is turned on to drive the push plate 5 to slide along the push rail 6 and move from the lower linear section 61 to the upper linear section 63. During the sliding of the push plate 5, the bent portion 51 first contacts the bamboo strips to bend and crush the bamboo strips, meanwhile, the cutting edges of the woody parts of the bamboo strips are bent upwardly and reversely under the action of bending and crushing. As the push plate 5 continues to slide, the bamboo strips are pushed to the upper surface of the machine cover 3 by the push plate 5. As the push plate 5 further continues to slide, the bamboo strips are pushed and moved in the direction of the distal end of the machine cover 3, so that the fiber and the base structure are slowly delaminated and peeled and separated out into large bundles from the bamboo strips because of bending, crushing and stretching, so that the bamboo strips are delaminated and split into fiber. Due to stress concentration, the cutting edges of the woody parts of the bamboo strips enables the woody parts of the bamboo strips to be naturally separated into bamboo sheets (that is, the woody part of the bamboo is in the form of a sheet). The woody parts of the bamboo strips can be used as fuel, etc., that is, the woody parts of the bamboo strips are completed separated from the green parts of the bamboo strips.

When the push plate 5 is slid to completely locate on the upper linear section 63, a set of bamboo strips are delaminated into fiber, and then the push plate 5 is returned to the original position, i.e., the upper linear section 61, under the action of the power source 7. Finally, the sepal aced bamboo fiber is taken out.

From the foregoing, it can be seen that the present invention provides a manufacturing method for obtaining bamboo fiber by mechanical and physical properties. Fully utilizing its anisotropic and non-uniform characteristics, bamboo is first heated to change its nature and compelled to move along the curved surface 33 of the machine cover 3. With the sliding of the push plate 5 on the push rail 6, the bamboo is stretched, bent and crushed to be greatly destroyed by geometric nonlinear distortion. Cracks appear in the fiber and base structure of the bamboo during the process. As the cracks continue to expand, the fiber and base structure are separated out into large bundles from the bamboo, so that the woody part of the bamboo is completed delaminated and separated from the green parts of the bamboo, that is, the bamboo is delaminated into fiber (bundle). The entire production process is simple and easy, greatly improving production efficiency and reducing production costs. In addition to realizing the delamination and separation of the woody part and the green part of the bamboo, it not only has a high output rate of fiber, and it is environmentally friendly in production without pollution. The bamboo structure can be deformed by the crush force and bending, so that the obtained bamboo fiber (bundle) has good elasticity, good toughness, fine fiber fineness and uniformity. The manufacturing apparatus 100 for delaminating a bamboo into fiber according to the present invention has a simple structure, is easy for operation and use, occupies less area, and can be used widely.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A manufacturing apparatus for delaminating a bamboo into fiber, comprising a machine frame extending in a direction from a left end to a right end, a machine seat, a machine cover engageable with the machine seat, a machine cover rail, a push plate, a push rail, at least one power source that is mechanically and operatively coupled to the push plate and is operable to move the push plate, and at least one elastic member;

the machine seat being disposed at a middle portion of the machine frame, a top of the machine seat being provided with a plurality of juxtaposed grooves and a first heating assembly, the first heating assembly being embedded in the machine seat and located under the grooves; a bottom of the machine cover being provided with a plurality of ribs and a second heating assembly, the ribs corresponding in position and in number to the grooves, the second heating assembly being embedded in the machine cover and located above the ribs;

the machine cover rail and the push rail being arranged on the machine frame, the machine cover being provided on and slidable along the machine cover rail, the elastic member being arranged between the machine cover and a right end portion of the machine frame, the push plate being provided on the push rail and being slidable along the push rail as being moved by the at least one power source;

the machine cover rail including a left rail section and a right rail section arranged from left to right, the left rail section being arranged along the machine seat and located above the machine seat;

a right end portion of the push plate being bent upwards to form a bent portion, an included angle of 100-150° being defined on a top side of the push plate and between the bent portion and a flat portion of the push plate; the push rail including a lower linear section, a curved section and an upper linear section arranged from left to right, the curved section being extended between the upper linear section and the lower linear section, the upper linear section being parallel to the left rail section and located above the left rail section.

2. The manufacturing apparatus as claimed in claim 1, wherein the first heating assembly comprises a plurality of first heating strips evenly distributed and staggered with the grooves; and the second heating assembly comprises a plurality of second heating strips evenly distributed and staggered with the ribs.

3. The manufacturing apparatus as claimed in claim 1, wherein the elastic member is a compression spring, which comprises one end supported on the right end portion of the machine frame and an opposite end supported on a right end portion of the machine cover.

4. A manufacturing method for delaminating a bamboo into fiber by using the manufacturing apparatus as claimed in claim 1, comprising the following steps:

(1) the machine cover being pushed to slide to the right rail section, the elastic member being compressed to expose the grooves of machine seat, which are adapted to receive bamboo strips therein, such that woody parts of the bamboo strips are positioned against the grooves and the bamboo strips each have a portion of 5-8 cm extending beyond ends of the grooves of the machine seat to be exposed outside the grooves of the machine seat, the exposed portions of the bamboo strips being located on a left side of the machine seat;

(2) the machine cover covering the machine seat, the ribs of the machine cover pressing the bamboo strips, the first heating assembly and the second heating assembly being actuated simultaneously, the first heating assembly and the second heating assembly jointly heating the bamboo strips at a heating temperature;

(3) after the bamboo strips are heated for 3-10 minutes, the first heating assembly and the second heating assembly being turned off, the woody parts of the bamboo strips located at the left side of the machine seat being cut off to form a partly cut end of each of the bamboo strips; then, the power source being turned on to drive the push plate to slide along the push rail and move in a direction from an original position on the lower linear section toward the upper linear section, wherein during the sliding of the push plate, the bent portion of the right end portion of the push plate is brought into contact with partly cut ends of the bamboo strips and the sliding of the push plate drives the partly cut ends of the bamboo strips to move onto and then slide on a top of the machine cover, wherein the bamboo strips are bent, crushed and stretched to be deformed so that fibers and base structures of the bamboo strips are delaminated and peeled and the bamboo fibers are separated from the bamboo strips to have the woody parts of the bamboo strips completely separated from green parts of the bamboo strips;

(4) when the push plate being slid to completely locate on the upper linear section, the bamboo strips being delaminated into the fibers, and then the push plate being returned to the original position by the power source; finally, the separated bamboo fibers being taken out.

5. The manufacturing method as claimed in claim 4, wherein the first heating assembly comprises a plurality of first heating strips evenly distributed and staggered with the grooves; and the second heating assembly comprises a plurality of second heating strips evenly distributed and staggered with the ribs.

6. The manufacturing method as claimed in claim 4, wherein the elastic member is a compression spring, which comprises one end supported on the right end portion of the machine frame and an opposite end supported on the right end portion of the machine cover.

* * * * *